US007344041B2

(12) United States Patent
Heinicke et al.

(10) Patent No.: US 7,344,041 B2
(45) **Date of Patent: *Mar. 18, 2008**

(54) EASY OPEN CAN END WITH CUT PROTECTION

(75) Inventors: Paul R. Heinicke, Canton, OH (US); William A. Kirk, North Canton, OH (US)

(73) Assignee: Crown, Cork & Seal Company, Inc., Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/622,482

(22) Filed: Jan. 12, 2007

(65) Prior Publication Data

US 2007/0138181 A1 Jun. 21, 2007

Related U.S. Application Data

(63) Continuation of application No. 10/682,182, filed on Oct. 9, 2003, now Pat. No. 7,225,944.

(51) Int. Cl.
*B65D 17/34* (2006.01)

(52) U.S. Cl. ..... 220/269; 220/270

(58) Field of Classification Search ..... 220/265, 220/266, 269, 270, 272, 273, 695
See application file for complete search history.

(56) References Cited

U.S. PATENT DOCUMENTS 2,092,671 A 9/1937 Hildebrandt
2,765,094 A 10/1956 Ryan
3,411,661 A 11/1968 Perry
3,424,351 A 1/1969 Cilluffo et al.
3,696,961 A 10/1972 Holk
3,853,080 A 12/1974 Zundel
3,939,787 A 2/1976 Morrison et al.
3,986,632 A 10/1976 Morrison et al.
5,328,045 A 7/1994 Yoshida
6,401,956 B1 6/2002 Heinicke et al.
7,225,944 B2 * 6/2007 Heinicke et al. ..... 220/269

* cited by examiner

*Primary Examiner*—Anthony D. Stashick
*Assistant Examiner*—Harry A. Grosso
(74) *Attorney, Agent, or Firm*—Knoble, Yoshida & Dunleavy, LLC

(57) ABSTRACT

A container assembly for packaging nonliquid material includes a can body that may be filled with nonliquid material and an end panel that is secured to the can body, preferably by seaming. A score line that is formed in the end panel defines a first removable portion and a second nonremovable portion. Structure such as a tab is provided for initiating separation of the first removable portion from the second nonremovable portion at a first location along the score line that defines an axis of symmetry about which separation of the first removable portion from the second nonremovable portion during opening will progress substantially symmetrically. The score line is shaped so that the second nonremovable portion defines a spoon leveling shelf that is shaped and sized to permit a consumer to level a spoonful of nonliquid material. Moreover, at least one exposed edge of the spoon leveling shelf is afforded cut protection by a safety fold.

14 Claims, 2 Drawing Sheets

EASY OPEN CAN END WITH CUT PROTECTION

This is a continuation of U.S. application Ser. No. 10/682,182, filed Oct. 9, 2003, now U.S. Pat. No. 7,225,944, the entire disclosure of which is hereby incorporated by reference as if set forth fully herein.

BACKGROUND OF THE INVENTION

1. Field of the Invention

This invention relates to a can end that may be used for packaging various types of materials. More specifically, this invention relates to a can end that is configured to provide spoon leveling capability to a consumer as well as providing cut protection.

2. Description of the Related Technology

Easy open cans are in wide use throughout the world. Typically, an easy open can includes an end panel that has a score defining a removable portion and a nonremovable portion. A tab member that is attached to the end panel is typically provided to initiate separation between the removable and nonremovable portions. One type of easy open end that is typically used for packaging beverages has a relatively small removable portion that defines a pouring spout when removed. Another type of easy open end that is used for packaging materials such as canned fish and potato chips is designed so that nearly the entire end panel is removable. A third type of easy open end that is used in the packaging of certain types of nonliquid materials is designed so that nearly the entire end panel is removable, but that a limited amount of the end panel is retained as a ledge against which a spoon may be scraped in order to level the spoon when using the spoon to withdraw the nonliquid material from the container.

Unfortunately, in the latter type of easy open end a long edge is also exposed to the consumer, possibly posing a danger of cuts and abrasions to the consumer's fingers. Moreover, when using the end panel to level a spoon a consumer would often need to angle the spoon in order to make the most effective use of the edge of the ledge, which could cause part or all of the contents of the spoon to fall back into the container.

A need exists for an improved easy open can end of the spoon leveling type that reduces the potential for injury to the consumer and that provides a more effective spoon leveling structure.

SUMMARY OF THE INVENTION

Accordingly, it is an object of the invention to provide an improved easy open can end of the spoon leveling type that reduces the potential for injury to the consumer and that provides a more effective spoon leveling structure.

In order to achieve the above and other objects of the invention, a can end that is constructed according to a first aspect of the invention includes an end panel, a score line defined in the end panel, the score line defining a first removable portion of the end panel and a second nonremovable portion of the end panel, structure for initiating separation of the first removable portion from the second nonremovable portion at a first location along the score line, the first location being located along an axis of symmetry about which separation of the first removable portion from the second nonremovable portion during opening will progress substantially symmetrically; and wherein the score line is shaped so that the second nonremovable portion defines a spoon leveling shelf that is shaped and sized to permit a consumer to level a spoonful of nonliquid material, and wherein at least one exposed edge of said spoon leveling shelf is afforded cut protection by a safety fold.

According to a second aspect of the invention, a container assembly for packaging nonliquid material includes a can body; an end panel secured to the can body; a score line defined in said the panel, the score line defining a first removable portion of the end panel and a second nonremovable portion of the end panel; structure for initiating separation of the first removable portion from the second nonremovable portion at a first location along the score line, the first location being located along an axis of symmetry about which separation of the first removable portion from the second nonremovable portion during opening will progress substantially symmetrically; and wherein the score line is shaped so that the second nonremovable portion defines a spoon leveling shelf that is shaped and sized to permit a consumer to level a spoonful of nonliquid material, and wherein at least one exposed edge of the spoon leveling shelf is afforded cut protection by a safety fold.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
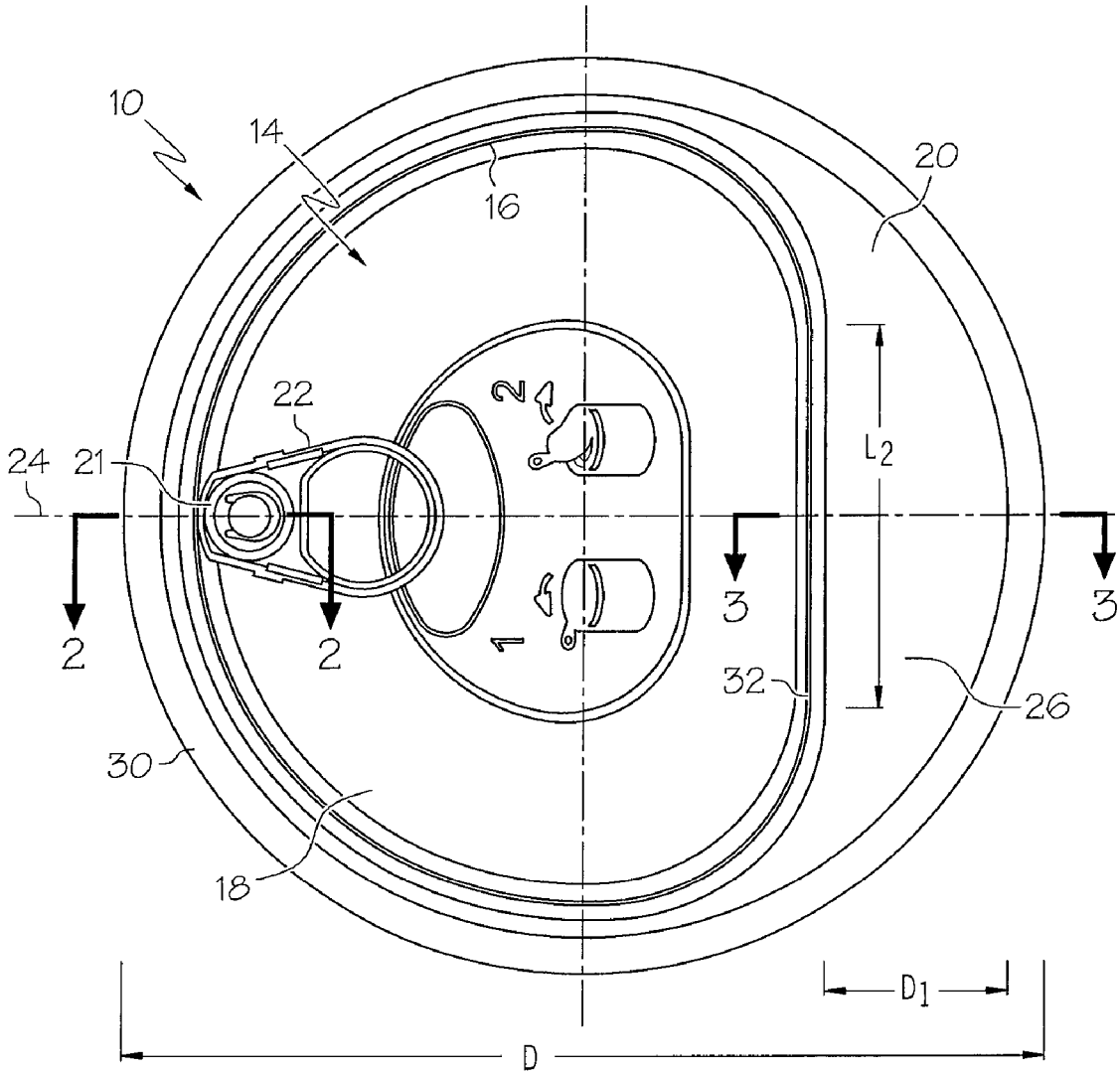
FIG. 1 is a top plan view of a can end that is constructed according to a preferred embodiment of the invention.
Figure 2:
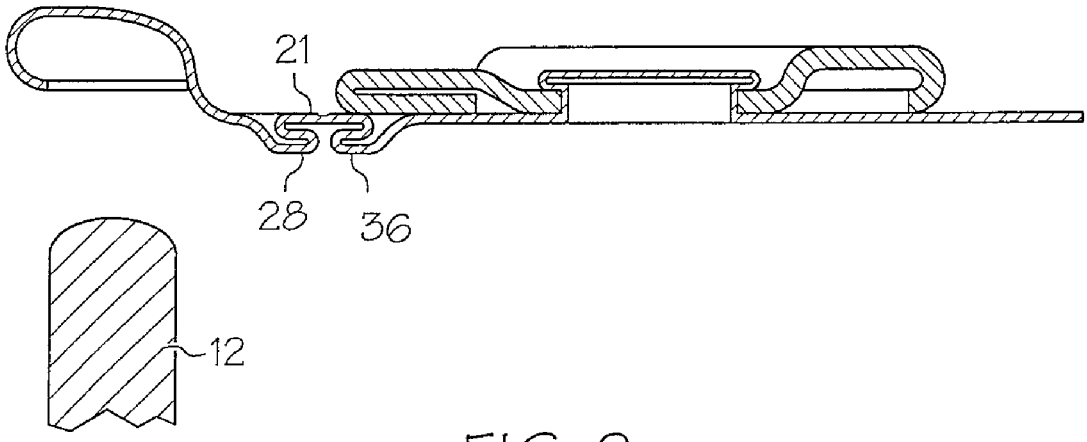
FIG. 2 is a diagrammatical view largely corresponding to cross-section 2-2 shown in FIG. 1.

Referring now to the drawings, wherein like reference numerals designate corresponding structure throughout the views, and referring in particular to FIG. 1, a container assembly tend for packaging nonliquid material includes, as shown in FIG. 2, a can body 12 and, returning to FIG. 1, an end panel 14 that is secured to the can body 12, preferably by use of conventional seaming structure 30. A score line 16 is defined in the end panel 14 that defines a first removable portion 18 of the end panel 14 and a second nonremovable portion 20 of the end panel 14. Conventional structure such as a tab 22 is provided for initiating separation of the first removable portion 18 from the second nonremovable portion 20 at a first location 21 along the score line 16. First location 21, as may be seen in FIG. 1, is located along an axis 24 of symmetry about which separation of the first removable portion 18 from the second nonremovable portion 20 during opening will progress substantially symmetrically as the tab 22 is pulled upwardly and outwardly by a consumer.

As may be seen in FIG. 1, score line 16 is shaped so as to be noncircular and so that the second nonremovable portion 20 defines a spoon leveling shelf 26 that is shaped and sized to permit a consumer to level a spoonful of nonliquid material. Moreover, as may best be seen in FIGS.

2 and 3, at least one exposed edge, and in the preferred embodiment the entire edge of the spoon leveling shelf 26 is afforded cut protection by a safety fold. In the preferred embodiment, a first safety fold 28 is provided radially outwardly beneath the entire periphery of the score line 16, and a second safety fold 30 is provided radially inwardly beneath the entire periphery of the score line 16.

Figure 3:
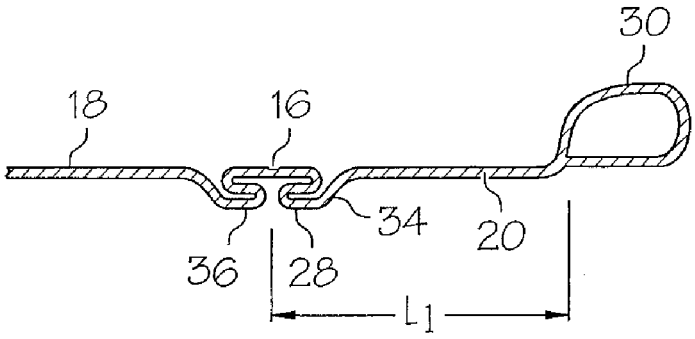
FIG. 3 is a diagrammatical cross-sectional view largely corresponding to cross-section 3-3 shown in FIG. 1.

Looking into FIG. 3, it will be seen that the spoon leveling shelf 26 has a length $L_1$ measured along the axis of symmetry 24 from the score line 16 to the outer circumference of the end panel 14 at which the transition to the seaming structure 30 begins. As may be seen in FIG. 1, a portion 32 of the exposed edge of the spoon leveling shelf extends linearly and substantially perpendicular to the axis of symmetry 24 for a distance $L_2$. The end panel 14 has a diameter taken along the axis of symmetry 24 that has a length $D_E$. Preferably, length $L_1$ is substantially within the range of about 15 percent to about 40 percent of the diameter $D_E$ of the end panel 14. More preferably, length $L_1$ is substantially within the range of about 25 percent to about 35 percent of the diameter $D_E$ of the end panel 14. Most preferably, length $L_1$ is substantially within the range of about 20 percent to about 30 percent of the diameter $D_E$ of the end panel 14. In addition, the length $L_2$ of the exposed edge of the spoon leveling shelf 26 preferably extends for a distance that is no less than the length $L_1$ of the spoon leveling shelf measured along the axis of symmetry 24.

According to another advantageous aspect of the invention, it will be seen in FIG. 3 that the safety fold 28 is connected to the second nonremovable portion 20 of the end panel 14 by a ramped transition portion 34. Ramped transition portion 34 is preferably sloped so that nonliquid material being removed from a spoon will be guided by the ramped transition portion 34 as the consumer withdraws the spoon. The incline of the transition portion 34 defines a space in which the excess material on the spoon may temporarily reside as the spoon is leveled by withdrawing the spoon while keeping the spoon in contact with the underside of the safety fold 28. Accordingly, a consumer may level the spoon more effectively than was possible using a simple edge portion of the end panel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A can end, comprising:

an end panel;

a noncircular score line defined in said end panel, said noncircular score line defining a first removable portion of said end panel and a second nonremovable portion of said end panel;

a first safety fold defined in said first removable portion;

a second safety fold defined in said second nonremovable portion, said first safety fold and said second safety fold both being located adjacent to said noncircular score line; and means for initiating separation of said first removable portion from said second nonremovable portion at a first location along said noncircular score line.

2. A can end according to claim 1, wherein said means for initiating separation of said first removable portion from said second nonremovable portion comprises a tab member.

3. A can end according to claim 1, wherein said noncircular score line includes a portion that is substantially linear.

4. A can end according to claim 1, wherein said first safety fold extends so as to be adjacent to an entire periphery of the noncircular score line.

5. A can end according to claim 1, wherein said second safety fold extends so as to be adjacent to an entire periphery of the noncircular score line.

6. A can end according to claim 1, wherein said first safety fold is positioned so as to be radially inward of and beneath said noncircular score line.

7. A can end according to claim 1, wherein said second safety fold is positioned so as to be radially outward of and beneath said noncircular score line.

8. A container assembly for packaging nonliquid material, comprising:

a can body;

an end panel secured to said can body;

a noncircular score line defined in said end panel, said noncircular score line defining a first removable portion of said end panel and a second nonremovable portion of said end panel;

a first safety fold defined in said first removable portion;

a second safety fold defined in said second nonremovable portion, said first safety fold and said second safety fold both being located adjacent to said noncircular score line; and means for initiating separation of said first removable portion from said second nonremovable portion at a first location along said noncircular score line.

9. A container assembly according to claim 8, wherein said means for initiating separation of said first removable portion from said second nonremovable portion comprises a tab member.

10. A container assembly according to claim 8, wherein said noncircular score line includes a portion that is substantially linear.

11. A container assembly according to claim 8, wherein said first safety fold extends so as to be adjacent to an entire periphery of the noncircular score line.

12. A container assembly according to claim 8, wherein said second safety fold extends so as to be adjacent to an entire periphery of the noncircular score line.

13. A container assembly according to claim 8, wherein said first safety fold is positioned so as to be radially inward of and beneath said noncircular score line.

14. A container assembly according to claim 8, wherein said second safety fold is positioned so as to be radially outward of and beneath said noncircular score line.

* * * * *